United States Patent [19]

Kalin

[11] Patent Number: 5,070,915

[45] Date of Patent: Dec. 10, 1991

[54] TEXTILE SUBSTRATE FOR SEAT COVERINGS

[75] Inventor: Albin Kalin, Widnau, Switzerland

[73] Assignee: Jacob Rohner AG, Rebstein, Switzerland

[21] Appl. No.: 398,236

[22] Filed: Aug. 24, 1989

[30] Foreign Application Priority Data

Aug. 31, 1988 [CH] Switzerland ..... 3256/88

[51] Int. Cl.[5] ..... D03D 15/00

[52] U.S. Cl. ..... 139/420 R; 139/420 A; 139/426 R; 428/225

[58] Field of Search ..... 139/420 R, 427, 426 R, 139/426 TN, 420 A; 428/225, 259; 66/202, 193; 297/219, 229

[56] References Cited

U.S. PATENT DOCUMENTS

| | | | |
|---|---|---|---|
| 2,882,933 | 4/1959 | Hindle et al. | 139/426 R |
| 4,067,209 | 1/1978 | Kucera et al. | 66/193 |
| 4,469,739 | 9/1984 | Gretzinger et al. | 139/420 R |
| 4,578,306 | 3/1986 | Heiman | 139/420 R |

FOREIGN PATENT DOCUMENTS

| | | | |
|---|---|---|---|
| 342813 | 7/1927 | Belgium . | |
| 639856 | 11/1963 | Belgium . | |
| 158820 | 2/1983 | Fed. Rep. of Germany | 139/420 R |
| 2109466 | 5/1972 | France . | |
| 2490688 | 3/1982 | France . | |
| 393214 | 10/1965 | Switzerland . | |

*Primary Examiner*—Andrew M. Falik

*Attorney, Agent, or Firm*—Egli International

[57] ABSTRACT

A substrate in the form of a fabric for seat coverings contains a higher portion of natural fibers than that of synthetic fibers. The substrate includes a mixed yarn produced of natural fibers formed by wool fibers and-/or ramie fibers. The substrate further contains from 15 to 30% by weight of synthetic fibers, preferably polyester fibers.

14 Claims, 1 Drawing Sheet

TEXTILE SUBSTRATE FOR SEAT COVERINGS

BACKGROUND OF THE INVENTION

The present invention relates to a textile substrate, which can be processed to form coverings for upholstered furniture, chairs and other seats and in which the substrate has at least one yarn, which is constructed as a mixed yarn having natural fibers.

Special demands have been typically made on material layers to be used for seat coverings. The term "seat" is used to define all types thereof, i.e. upholstered furniture, covered chairs, car seats, office chairs, as well as seats in vehicles, such as aircraft and trains, as well as for wheel-chairs for invalids and handicapped.

The demands to be made on such materials are of widely differing types and in part also have opposite tendencies, i.e. an improvement to one characteristic leads to a deterioration of another.

The sitting comfort resulting from such coverings is particularly important when the seat is used for considerable periods, without the user being able to leave it. Such a situation e.g. occurs with invalids confined to wheel-chairs, the invalid only being able to leave the chair with external aid. A similar situation exists with the driver of a motor vehicle, if he has to cover long distances without being able to interrupt the journey. Similar conditions also exist for aircraft and rail travellers, which involve long periods during which the traveller sits.

Even when sitting, the human body evolves heat, which is given off to the environment. The amount of heat to be dissipated is dependent on the heat resistance of the environment. If this is too high, the body is unable to maintain its heat balance, which leads to perspiration which cools the body. If this perspiration is insignificant and hardly detectable, then it does not lead to discomfort for the person involved. However, in the case of significant perspiration it leads to liquid formation, then the seat feels unpleasant if it is not possible to remove the moisture. The well-being of the person seated for a long time depends both on the clothing and in particular on the seat covering and the heat resistance thereof.

It has been known to use in the clothing field the materials which have a low heat resistance and therefore facilitate perspiration of the body to the outside and largely prevent the penetration of wind and rain. Such articles of clothing consist of a laminate, where use is made of two or three layers. One of these layers is a thin membrane of polytetrafluoroethylene (PTFE), which contains microscopically small pores. The small pores of this water-repelling membrane do not permit penetration of water therethrough. However, it is possible for water vapor, such as is produced through the heat evolution of the human body, to diffuse through the pores.

However, such laminates cannot be used for seats, because the water vapor forming on the body reaches the outer surface of the covering and would have to be given off to the environment. However, as substantially all seats have an upholstery comprising plastic inserts and foams, which have a high heat resistance, the water vapor passing through the membrane can only be given off to a minor extent, if at all, to the environment.

SUMMARY OF THE INVENTION

It is an object of the present invention to develop an improved substrate of the aforementioned type, in which its heat resistance is kept low and it is possible to achieve an adequate water vapor dissipation to the environment, without impairing the absorptivity and abrasion resistance of the material itself.

According to the invention this and other objections of the invention are attained by a textile substrate which has at least 65 to 85% by weight of natural fibers, while the remainder of the substrate are synthetic fibers. Appropriately it has 65 to 80% by weight of natural fibers of wool and ramie, the mixed yarn being formed from wool and ramie.

In an embodiment, the substrate contains from 65 to 85% by weight of natural fibers of wool and ramie so that said mixed yarn is formed from wool and ramie.

In an embodiment, the synthetic fibers are mixed with the mixed yarn.

In an embodiment, the natural fibers in said mixed yarn are formed from animal and plant fibers.

In an embodiment, the amount of ramie fibers in the mixed yarn is 15 to 30% by weight.

In an embodiment, synthetic fibers of the substrate comprise at least 15% by weight of polyester fibers.

DETAILED DESCRIPTION OF THE PREFERRED EMBODIMENTS

Figure 1:
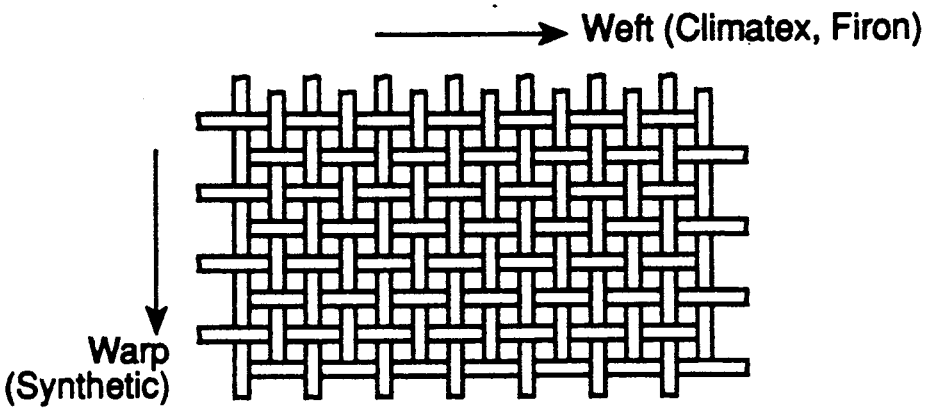
FIG. 1 is a plan view of a substrate with synthetic warp threads and weft threads of Climatex yarn.
Figure 2:
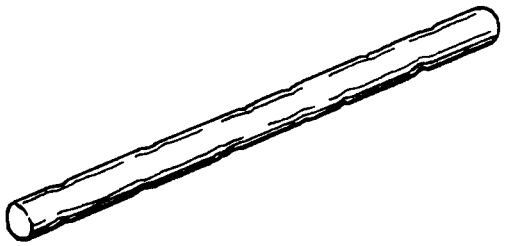
FIG. 2 is a perspective view of a yarn of Climatex or Firon containing blend of wool/ramie in proportion 80 to 20.
Figure 3:
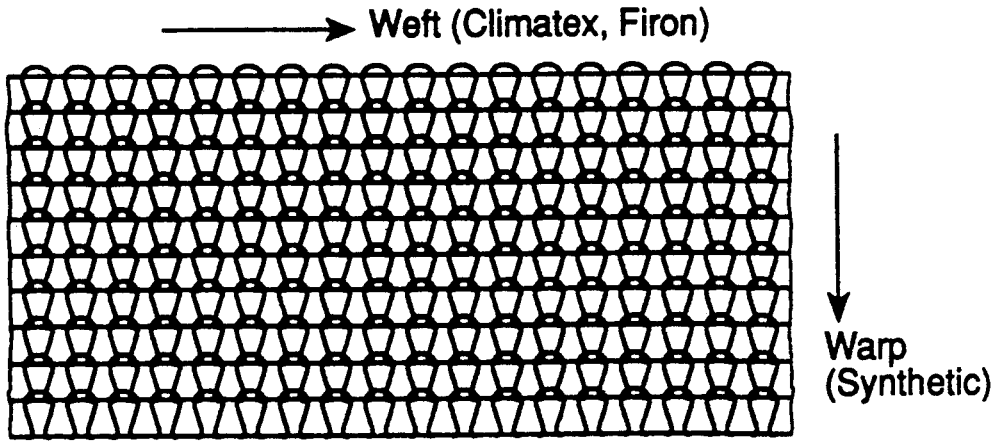
FIG. 3 shows a Raschel design of the substrate according to the invention.

The present invention is based on the idea that the sitting comfort of a seat covering can be improved in that the water vapor produced by the person sitting on the seal is led off within the textile substrate used as the covering and can be given off to the environment.

The textile substrate to be used as a covering for the sitting and back parts of seats must be very hardwearing, because such materials must be usable for a very long period. This is more particularly required in public transport vehicles, such as aircraft and trains. It is known that materials woven with plastic yarns are very hardwearing. Admittedly, as a result of a plastic yarn the moisture formed on the body is rapidly passed on, but such a yarn cannot absorb and store moisture. This means that even when small moisture quantities are present, the impression is given that the material is moist. This is considered unpleasant by the seat user and is therefore evaluated as inadequate sitting comfort.

It is also known that wool has a high moisture absorptivity, so that a wool covering offers pleasant sitting comfort for as long as the absorptivity limit is reached. However, wool is a very poor moisture conductor, so that when a material formed from a wool yarn is used for a long time, a considerable sitting comfort reduction must be expected as soon as the moisture absorptivity is exhausted.

In order to improve the undesired characteristics of plastic and wool, coverings were produced in which the material was woven from a synthetic yarn and a wool yarn.

The textile substrate of the present invention is comprised of at least one mixed yarn of natural fibers. The proportion of natural fibers in the substrate is from 65 to 85% by weight whereas the remainder are synthetic fibers.

For example, a synthetic yarn was used for the warp and a wool yarn for the weft. Although seat coverings made from such a material offer a good sitting comfort, this is only within the scope of the characteristics of the wool and the synthetic material, i.e. leading off of moisture and absorptivity in accordance with the wool and synthetics proportions. Even though the use of a synthetic yarn improved the leading off of water vapor, after a relatively short time the seat user experienced a subjectively determinable decrease in the sitting comfort.

Further research for improving the sitting comfort has led to the use of a mixed yarn in place of the wool yarn. Surprisingly the sitting comfort was only improved when using a mixed yarn of wool and ramie. Ramie is a bast fiber and one of the oldest fibers used for production of textiles. Ramie and a similar plant known as china grass more particularly grow under tropical and subtropical climatic conditions. Under suitable climatic conditions, the perennial ramie plant reaches the height of 120–250 cm, and there can be up to five harvests every year. Ramie fibers cleaned by decortication and degumming largely consist of cellulose and therefore behave in much the same way as cotton, but are smoother, stiffer and more lustrous.

Using the aforementioned mixed yarn, it has been possible to produce seat coverings giving a considerably increased sitting comfort.

Comparative tests were performed by the Springborn Laboratories (Europe) AG in CH-9326 Horn. The moisture transport in a fabric union was measured in the transverse and longitudinal direction, in that the height of rise of water was established. The test was based on the use of a covering material, the warp threads of which consisted of a polyester fiber PE/CS under the Tradename "TREVIRA", whereas the weft thread consisted of a woven fabric of the present applicant known under the Trademark "CLIMATEX". The composition of this woven fabric is comprised of 23% polyester PE/CS, 15% ramie RA (fiber with the Trademark name FIRON of Ernest H. Fischers Söhne, CH-5605 Dottikon) and 62% wool WO. The height of rise in the yarn direction after three hours was 19.5 cm and in the weft direction 16.9cm.

In the case of a comparison material, the warp and weft threads of which consisted of PE/CS, the values of the material after three hours were 20.8 cm in the warp direction and 18.0 cm in the weft direction. Thus, the height of rise for a material made from 100% PE/CS was only slightly higher than that of the material with the mixed yarn "CLIMATEX" used as the weft. The material consisting solely of PE/CS only gives a limited sitting comfort, whereas that with the mixed yarn fulfills very high demands with regards to the sitting comfort. In addition, the tear resistance of the material is increased by using ramie fibers.

It is mentioned for comparison purposes, that in a fabric union, in which the weft and warp threads consisted of 100% wool, the height of rise in both the transverse and longitudinal directions after one and three hours were substantially zero. The aforementioned favorable results can only be obtained with mixed yarns, in which to the natural fibers thereof are added cotton, linen, staple fiber with wool or other animal or synthetic fibers.

The preferred composition for coverings for increasing the sitting comfort of seats is comprised at 50 to 70% wool, 10 to 20% ramie and 15 to 35% polyester.

The polyester fibers in the mixed yarn can be replaced by polypropylene, polyacrylic, aramide and polyamide fibers. It is also possible to add to the mixed yarn metal fibers so that the yarn acquires antistatic properties. A portion of the mixed yarn metal fibers in the composition may be from 1 to 5% by weight.

If high antistatic suitability must be achieved, it is appropriate not to use metal fibers in the mixed yarn but instead to weave a separate metal wire into the covering fabric.

The substrate can be constructed as a woven fabric, but also as Raschel or Malimo. The mixed yarn can be used both as the weft and the warp threads. If it is used as the weft, the warp can be a synthetic yarn. However, if the mixed yarn is used as the warp thread, the weft comprises a synthetic yarn. However, it is also possible to use a mixed yarn for both the weft and warp threads for such coverings. In this case synthetic fibers of the aforementioned type are added to the mixed yarn, so that the aforementioned percentages are achieved.

Covering materials give a high sitting comfort if both the weft and the warp threads are made from the mixed yarn. As a result of the high tear resistance of ramie and polyester fibers, the abrasion resistance of such a material is comparable with that made from synthetics only. Covering materials in which the weft and/or warp threads are made from the described mixed yarns, can also be provided with a fire-retarding finish, without influencing the sitting comfort, i.e. the moisture transport through the fabric.

The weave of the fabric has only a limited influence on the moisture transport. Yarns with counts Nm 10/2-42/2 are appropriately used for the mixed yarn.

While particular embodiments of the present invention have been shown as described, it will be obvious to those skilled in the art that changes and modifications may be made without departing from the invention in its broader aspects. Therefore, the aim in the appended claims is to cover all changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A textile substrate for use for coverings of upholstered furniture, chairs and the like seats, the substrate comprising at least one yarn formed of a mixed yarn with natural fibers, wherein the substrate contains from 65 to 85% by weight of natural fibers of wool and ramie so that said mixed yarn is formed from wool and ramie and the remainder of fibers are synthetic fibers.

2. Substrate according to claim 1, wherein said synthetic fibers are mixed with the mixed yarn.

3. Substrate according to claim 1, wherein the amount of said ramie fibers in the mixed yarn is 15 to 30% by weight.

4. Substrate according to claim 1, wherein the synthetic fibers of the substrate comprise at least 15% by weight of polyester fibers.

5. Substrate according to claim 4, wherein the synthetic fibers of the substrate comprise from 15 to 35% by weight of polyester fibers.

6. Substrate according to claim 1, wherein said synthetic fibers are selected from the group consisting of polypropylene, polyamide, polyester, polyacrylics and aramide.

7. Substrate according to claim 1, wherein said substrate is a fabric in the form of Malimo.

8. Substrate according to claim 7, wherein said mixed yarn is in the form of weft threads and said synthetic fibers are in the form of warp threads.

9. Substrate according to claim 7, wherein said mixed yarn is in the form of warp threads and said synthetic fibers are in the form of weft threads.

10. Substrate according claim 1, a wherein said substrate is a fabric having warp and weft threads, in which both are formed of the mixed yarn.

11. A textile substrate for use in coverings of upholstered furniture, chairs and the like seats, comprising at least one yarn formed of a mixed yarn with natural fibers, of wool and ramie the substrate containing from 65 to 85% by weight of natural fibers, and the remainder of fibers being synthetic fibers, wherein said substrate is a fabric in the form of Raschel.

12. Substrate according to claim 11, wherein said mixed yarn forms weft threads and said synthetic fibers form warp threads.

13. Substrate according to claim 11, wherein said mixed yarn forms warp threads and said synthetic fibers form weft threads.

14. A textile substrate for use in coverings of upholstered furniture, chairs and the like seats, comprising at least one yarn formed of a mixed yarn with natural fibers, the substrate containing from 65 to 85% by weight of natural fibers and the remainder of fibers being synthetic fibers, wherein said mixed yarn comprises from 50 to 70% by weight of wool and from 10 to 20% by weight of ramie, and said synthetic fibers comprise from 15 to 35% by weight of polyester.

* * * * *